US010037754B1

(12) United States Patent
Hollmann

(10) Patent No.: US 10,037,754 B1
(45) Date of Patent: Jul. 31, 2018

(54) SURGICAL HELMET WITH HEARING PROTECTION

(71) Applicant: Mark W. Hollmann, Deland, FL (US)

(72) Inventor: Mark W. Hollmann, Deland, FL (US)

( * ) Notice: Subject to any disclaimer, the term of this patent is extended or adjusted under 35 U.S.C. 154(b) by 0 days.

(21) Appl. No.: 14/861,614

(22) Filed: Sep. 22, 2015

Related U.S. Application Data

(60) Provisional application No. 62/053,398, filed on Sep. 22, 2014.

(51) Int. Cl.
*G10K 11/16* (2006.01)
*G10K 11/178* (2006.01)
*A42B 3/30* (2006.01)

(52) U.S. Cl.
CPC ..... *G10K 11/178* (2013.01); *A42B 3/306* (2013.01); *G10K 2210/1081* (2013.01); *G10K 2210/116* (2013.01)

(58) Field of Classification Search
CPC ..... A61M 2205/42
USPC ..... 381/71.6
See application file for complete search history.

(56) References Cited

U.S. PATENT DOCUMENTS 6,101,256 A * 8/2000 Steelman ..... H04R 5/023 381/122
8,391,530 B2 3/2013 Grandt et al.
2004/0218776 A1* 11/2004 Rolla ..... A42B 3/166 381/374
2006/0213523 A1* 9/2006 VanDerWoude ... A41D 13/0025 128/863
2010/0183182 A1* 7/2010 Grandt ..... A42B 3/166 381/367
2012/0177213 A1* 7/2012 Le Faucheur ..... H04R 1/1083 381/71.6
2014/0079235 A1* 3/2014 Lyons ..... G10K 11/178 381/71.6
2014/0105412 A1* 4/2014 Alves ..... G10K 11/178 381/71.6
2014/0198923 A1* 7/2014 Miet ..... G10K 11/178 381/66

FOREIGN PATENT DOCUMENTS

EP 1538601 12/2004
WO 2012025608 3/2012

* cited by examiner

*Primary Examiner* — Akelaw Teshale

(74) *Attorney, Agent, or Firm* — Allen Dyer Doppelt & Gilchrist

(57) ABSTRACT

A surgical helmet assembly includes a surgical helmet, headphones mounted on the surgical helmet, and a noise cancellation system configured to supply a noise cancelling audio input to the headphones to mitigate unwanted ambient noise. A gain of the noise cancelling audio input is configurable to permit necessary feedback noise from surgical tools or the like to be heard by the wearer.

18 Claims, 4 Drawing Sheets

SURGICAL HELMET WITH HEARING PROTECTION

CROSS-REFERENCE TO RELATED APPLICATION

This application claims the benefit of U.S. Provisional Application Ser. No. 62/053,398, filed on Sep. 22, 2014, the contents of which are herein incorporated by reference in their entirety.

FIELD OF THE INVENTION

The present invention relates to surgical helmets, and more particularly, to hearing protection for use in conjunction therewith.

BACKGROUND OF THE INVENTION

Several studies have shown that the noise caused by power instruments, such as saws and drills, during orthopedic surgery may cause hearing loss. A body exhaust suit, or surgical "space suit," is commonly worn during such surgical procedures. While such suits feature a hood and helmet with exhaust fan, further improvements to hearing protection afforded are possible.

SUMMARY OF THE INVENTION

In view of the foregoing, it is an object of the present invention to provide an improved surgical helmet including hearing protection, and related methods of making and use. According to an embodiment of the present invention, a surgical helmet assembly includes a surgical helmet, headphones mounted on the surgical helmet, and a noise cancellation system configured to supply a noise cancelling audio input to the headphones to mitigate unwanted ambient noise. According to an aspect of the present invention, the wearer can adjust the gain of noise cancelling audio input. According to another aspect, the noise cancellation circuitry also applies noise cancellation to an audio input from a wearer microphone.

These and other objects, aspects and advantages of the present invention will be better understood in view of the drawing and following detailed description of preferred embodiments.

DETAILED DESCRIPTION OF PREFERRED EMBODIMENTS

Figure 1:
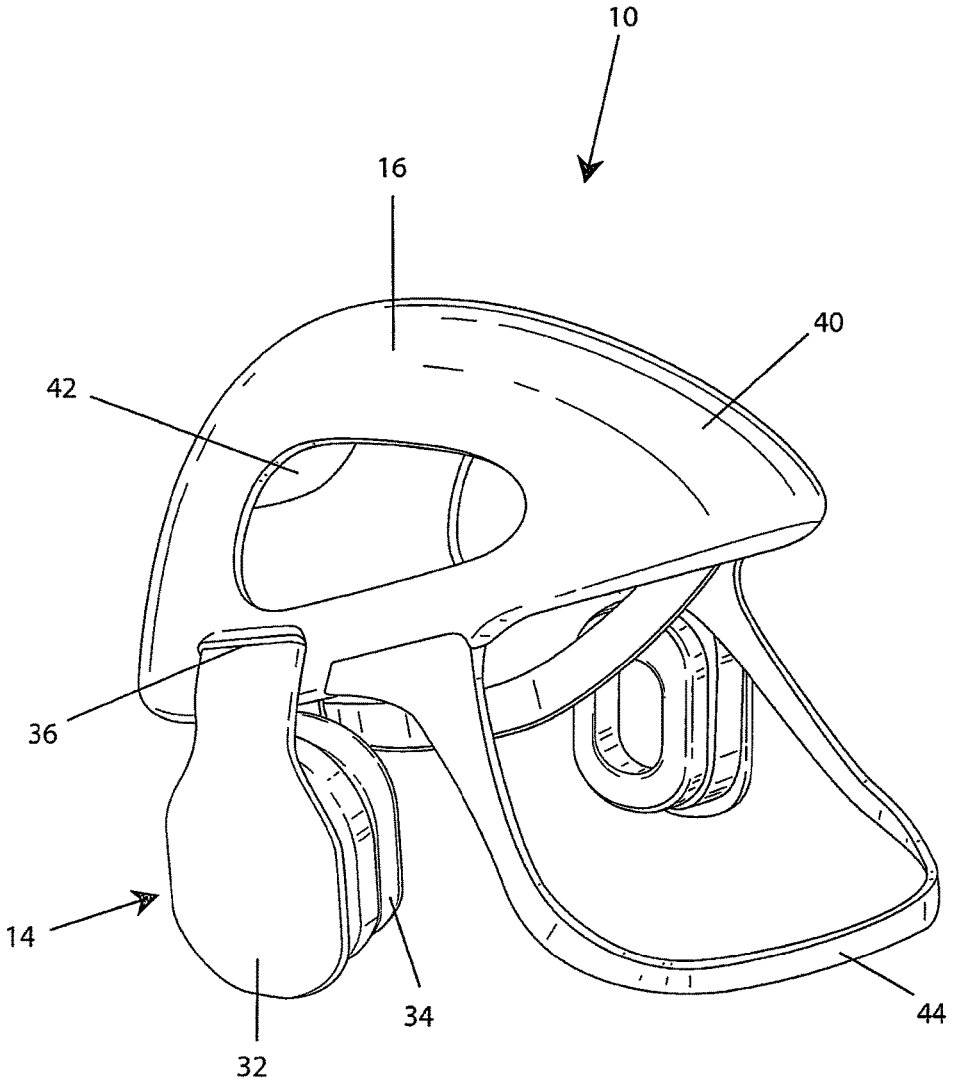
FIG. 1 is a perspective view of a helmet equipped with a noise cancellation system, according to an embodiment of the present invention.
Figure 2:
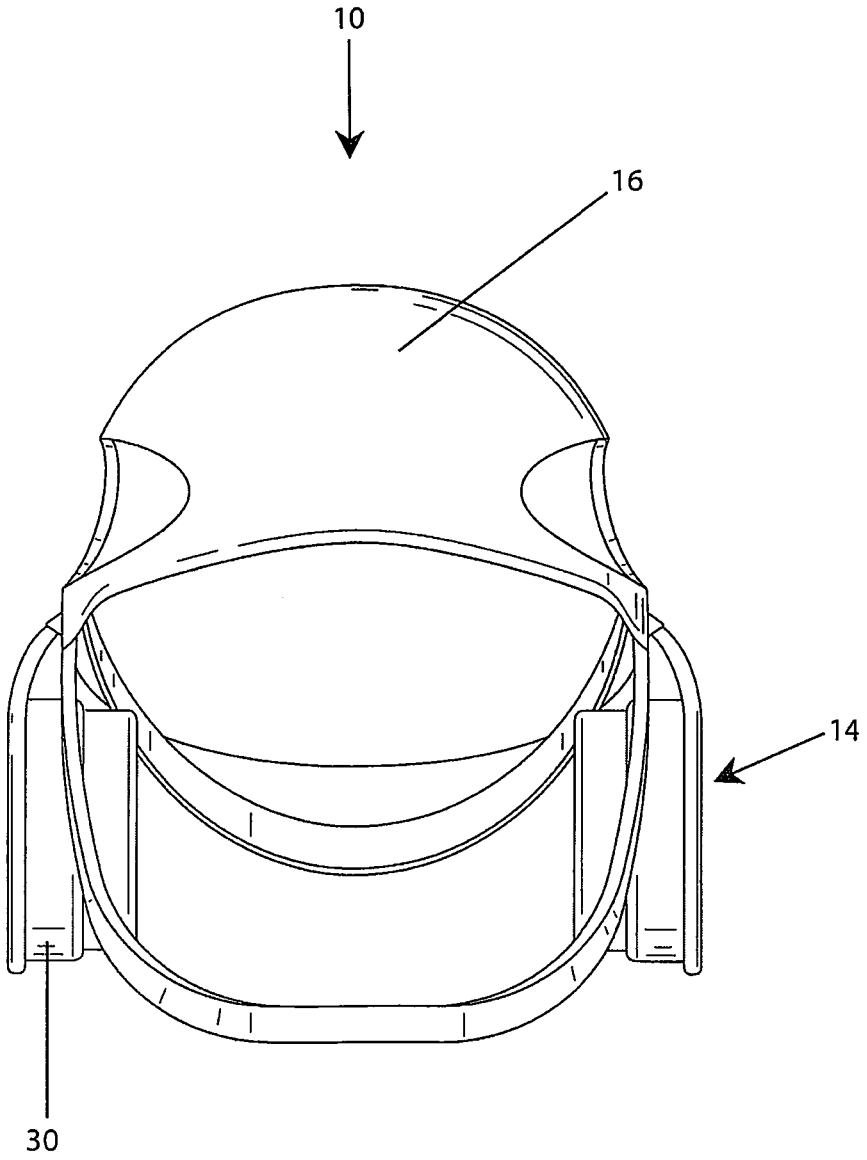
FIG. 2 is a front view of the helmet equipped with the noise cancellation system of FIG. 1.
Figure 3:
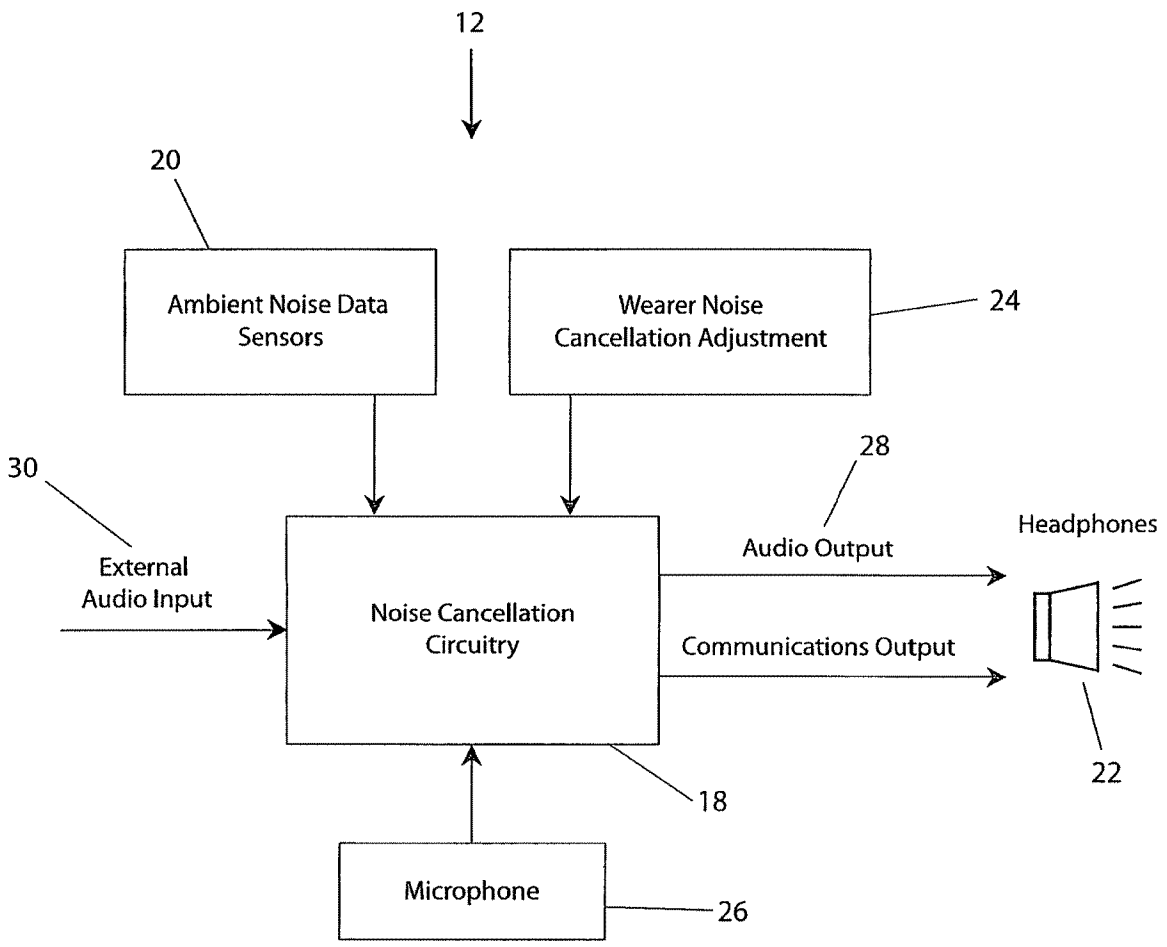
FIG. 3 is a schematic overview of the noise cancellation system.

According to an embodiment of the present invention, referring to FIGS. 1-3, a surgical helmet assembly 10 includes a noise cancellation system 12 and headphones 14 mounted on a surgical helmet 16. The noise cancellation system 12 is configured to supply a noise cancelling audio input to the headphones 14 in order to mitigate unwanted ambient noise. Advantageously, the noise cancellation system 12 is configured with active noise cancellation, as will be described in greater detail below, to reduce or eliminate noise frequencies and/or levels that pose a hearing loss risk while allowing sufficient ambient noise to allow audible feedback to a wearer from power tool operation.

Directional terms, such as left, right, front and back are referenced to an orientation in which the surgical helmet assembly 10 is worn by an upright wearer. However, the present invention is not limited thereby to use in any particular orientation.

In an active noise cancellation embodiment, referring more particularly to FIG. 3, the noise cancellation system 12 includes noise cancellation circuitry 18 that receives inputs from one or more ambient noise data sensors 20 and drives one or more headphone speakers 22 based thereon. Active noise cancellation is preferred, although the present invention can extend to embodiments utilizing more passive noise cancellation; for instance, where the assembly 10 is intended for use in connection with a specific tool with well-known operating noise characteristics. In such an embodiment, the noise cancellation circuitry 18 could be preset to generate an audio output signal predetermined to cancel noise from the specific tool. A manual or automatic phase adjustment could be included to ensure the predetermined output signal was out-of-phase with the noise generated by the tool.

The noise cancellation circuitry 18 employs digital noise cancellation, analog noise cancellation, or a combination of both, to generate a noise cancellation signal supplied to the headphone speakers 22 to create destructive interference with the unwanted ambient noise. Advantageously, a wearer noise cancellation adjustment 24 supplies a further input to the circuitry 18 to allow the wearer to adjust the gain of the noise cancellation signal. The circuitry 18 can be configured to uniformly cancel ambient noise or preferentially suppress certain frequencies more than others.

The ambient noise data sensor 20 preferably includes at least one microphone that senses the ambient noise and generates an input to the noise cancellation circuitry 18 representative thereof, although the present invention is not necessarily limited thereto. For instance, in applications where the potentially hazardous ambient noise is generated from one or more surgical power tools, the ambient noise data sensor 20 could include a sensor generating an indication of the operating speed and/or other operating parameters of the tools, from which the noise cancellation circuitry 18 derives the proper noise cancellation signal to be generated.

In certain applications, it may be desirable to electronically relay audible communications to and from the wearer of the helmet assembly 10. For example, voice communications between operating room personnel, remote observers and/or recording devices. For such applications, the noise cancellation system 12 advantageously further includes a wearer microphone 26 to sense spoken communications from the wearer. The noise cancellation circuitry 18 also receives an audio input from the microphone 26 and can advantageously apply noise cancellation thereto, in which case the noise cancellation generates a multi-part output 28 including the audio output that is the noise cancelling audio input to the headphones 14, and a communications output signal in which unwanted ambient noise has also been minimized or eliminated. Some or all of this communications output signal can be supplied back to the wearer as feedback.

In such an embodiment, the circuitry 18 advantageously also includes an external audio input 30 to the headphone speakers 22; for example, voice communications from other personnel transmitted to the headphones 14. The communications output signal, with noise cancellation applied, can also be supplied for transmission to other personnel. Advantageously, the communications output signal can have more complete noise cancellation applied thereto. For instance, while hearing some power tool noise may be advantageous to the wearer, such noise may not be useful or desirable to other personnel listening to communications from the wearer.

Advantageously, some or all of the components of the noise cancellation system 12 can be physically located within the headphones 14 in addition to the speakers 22. Alternately, some or all of the additional components could be located externally to the headphones 14 while remaining in signal communication with the speakers 22. Additionally, the system 12 could include redundant components, such as separate noise cancellation circuitry 18 and ambient noise data sensors 20 for each headphone 14.

In the depicted embodiment, referring again to FIGS. 1 and 2, the headphones 14 each include a headphone shell 32 with padding 34 attached thereto, in addition to the speaker 22. A mounting member 36 connects the shell 32 to the helmet 16. Preferably, the mounting member 36 lightly biases the shell 32 inwards, such that the padding 34 of each headphone 14 is gently but firmly held against the head of the wearer. As used herein, the term "headphone" should be understood to encompass any ear covering equipped with a speaker and capable of blocking the transmission of ambient noise into the ear. Circumaural headphones, as in the depicted embodiment, are believed to represent a preferred embodiment, but the present invention is not necessarily limited thereto. For instance, embodiments of the present invention could employ earbuds connected to a noise cancellation system.

The helmet 16 includes a helmet shell 40 with one or more pads 42 attached to an inner surface thereof. A chin bar 44 extends outwardly from the front of the helmet shell 40, and offers a convenient mounting location for a wearer microphone 26. Preferably, additional accessories are also mounted in or on the helmet 16, such as a ventilation fan, surgical light, and an electrical power pack.

Figure 4:
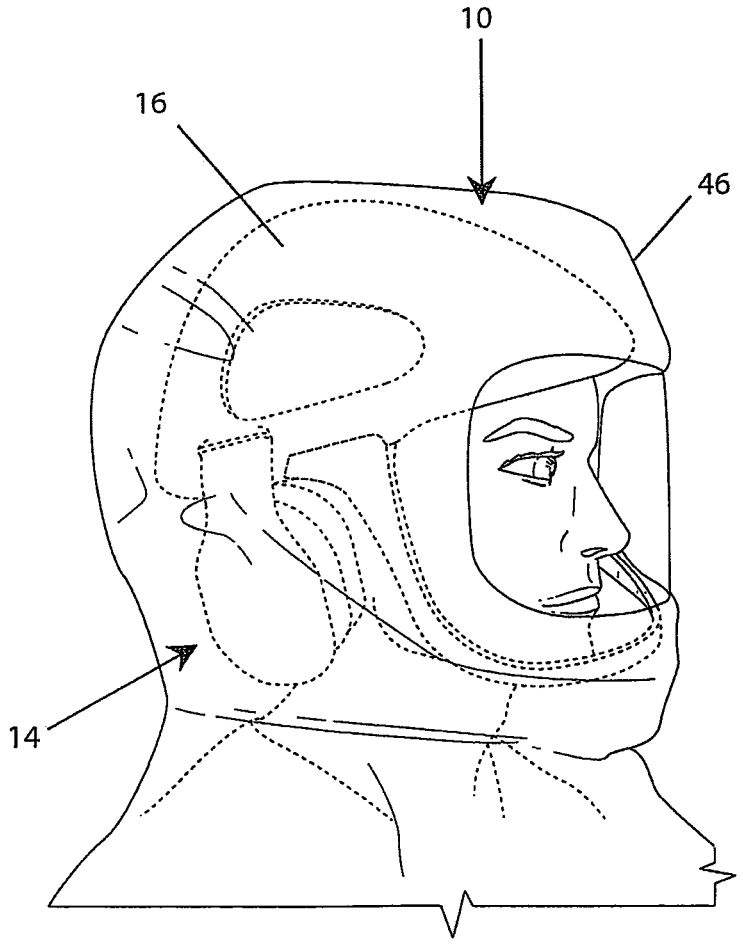
FIG. 4 is a perspective view of the helmet of equipped with the noise cancellation system of FIG. 1, with a body exhaust suit.

In use, the wearer dons the helmet 16, placing the headphones 14 over each ear. As seen in FIG. 4, an exhaust suit head covering 46 is arranged over the helmet assembly 10. If necessary, the wearer energizes the noise cancellation system 12 and adjusts the noise cancellation level to his or her preference prior to or during a surgical procedure.

From the foregoing, it will be appreciated that a helmet assembly according to the present invention offers useful hearing protection to operating room personnel by mitigating unwanted ambient noise, while still allowing a degree of ambient noise to be heard for feedback when operating power tools.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described and of the claims appended hereto.

What is claimed is:

1. A surgical helmet assembly comprising: a surgical helmet;

headphones mounted on the surgical helmet; and a noise cancellation system configured to supply a noise cancelling audio input to the headphones to mitigate unwanted ambient noise;

wherein the noise cancellation system includes noise cancellation circuitry and at least one ambient noise data sensor for supplying an input thereto; and wherein the at least one ambient noise data sensor includes at least one sensor generating an indication of an operating parameter of a surgical tool based on which the noise cancellation circuitry generates the noise cancelling audio input.

2. The surgical helmet assembly of claim 1, wherein the headphones are circumaural headphones, each including a headphone shell with padding attached thereto and a speaker arranged therein.

3. The surgical helmet assembly of claim 2, wherein noise cancellation circuitry of the noise cancellation system is arranged in at least one of the headphone shells.

4. The surgical helmet assembly of claim 3, wherein the noise cancellation circuitry includes redundant components arranged in each of the headphone shells.

5. The surgical helmet assembly of claim 2, wherein the headphones each include a mounting member connecting the headphone shell to the surgical helmet.

6. The surgical helmet assembly of claim 5, wherein each mounting member biases its headphone shell inwards.

7. The surgical helmet assembly of claim 1, wherein the noise cancellation system includes a wearer noise cancellation adjustment allowing a wearer to adjust gain of the noise cancelling audio input.

8. The surgical helmet assembly of claim 1, wherein the at least one ambient noise data sensor includes at least one microphone for sensing ambient noise and generating an input to the noise cancellation circuitry representative thereof.

9. The surgical helmet assembly of claim 1, wherein the at least one sensor senses operating speed.

10. The surgical helmet assembly of claim 1, wherein the noise cancellation system includes noise cancellation circuitry preset to generate the noise cancelling audio input to cancel noise from a specific tool.

11. The surgical helmet assembly of claim 10, wherein the noise cancellation system further includes a phase adjustment for the noise cancelling audio input.

12. The surgical helmet assembly of claim 1, wherein the noise cancellation system includes a wearer microphone for sensing spoken communications from a wearer and noise cancellation circuitry for generating the noise cancelling audio input and applying noise cancellation to an audio input from the wearer microphone to generate a communications output signal.

13. The surgical helmet assembly of claim 12, wherein the noise cancellation circuitry applies a greater degree of noise cancellation to the communications output signal than to the noise cancelling audio input.

14. The surgical helmet assembly of claim 12, wherein at least a portion of the communications output signal is supplied to the headphones along with the noise cancelling audio input.

15. The surgical helmet assembly of claim 12, wherein the surgical helmet includes a helmet shell and a chin bar extending outwardly from the front of the helmet shell.

16. The surgical helmet assembly of claim 15, wherein the wearer microphone is located on the chin bar.

17. The surgical helmet assembly of claim 1, further comprising an exhaust suit head covering arranged over the surgical helmet and headphones.

18. A surgical helmet assembly comprising: a surgical helmet; headphones mounted on the surgical helmet, each of the headphones including a headphone speaker; and a noise cancellation system configured to supply a noise cancelling audio input to the headphones to mitigate unwanted ambient noise, the noise cancellation system including at least one ambient noise data sensor and noise cancellation circuitry for generating the noise cancelling audio input based thereon, the noise cancellation system also including a wearer noise cancellation adjustment in communication with the noise cancellation circuitry allowing a wearer to adjust gain of the noise cancelling audio input;

wherein the at least one ambient noise data sensor includes at least one sensor generating an indication of an operating parameter of a surgical tool based on which the noise cancellation circuitry generates the noise cancelling audio input.

* * * * *